United States Patent [19]

Zeuner et al.

[11] 4,280,396

[45] Jul. 28, 1981

[54] HYDRAULIC OSCILLATOR

[75] Inventors: Kenneth W. Zeuner, Newtown; Alonzo B. Jarman, Wrightstown, both of Pa.

[73] Assignee: Control Concepts, Inc., Newtown, Pa.

[21] Appl. No.: 907,139

[22] Filed: May 18, 1978

[51] Int. Cl.[3] ..... F01L 25/06; F01L 31/08

[52] U.S. Cl. ..... 91/320; 91/337

[58] Field of Search ..... 91/320, 290, 298, 319

[56] References Cited

U.S. PATENT DOCUMENTS

| | | | |
|---|---|---|---|
| 109,980 | 12/1870 | Weinman | 91/320 |
| 217,952 | 7/1879 | Neff | 91/320 |
| 3,780,621 | 12/1973 | Romell | 91/290 |
| 3,983,788 | 10/1976 | Andersson et al. | 91/319 |

FOREIGN PATENT DOCUMENTS

| | | | |
|---|---|---|---|
| 1340 | of 1904 | United Kingdom | 91/320 |
| 1250892 | 10/1971 | United Kingdom | 91/320 |

*Primary Examiner*—Paul E. Maslousky

*Attorney, Agent, or Firm*—Allan Ratner

[57] ABSTRACT

A hydraulic oscillator in which a piston reciprocates between first and second positions in a cylinder. A reversing pilot valve controls fluid flow to ends of the cylinder and flow through first and second pilot passages control the reversing operation of the pilot valve. The cylinder has a pilot channel or groove coupled to a pilot supply line. The piston has (1) a first logic channel for fluidly coupling the pilot channel and first pilot passage as the piston approaches the second position and (2) a second logic channel for fluidly coupling the pilot channel and second pilot passage as the piston approaches the first position thereby to alternately reverse the pilot valve and produce the reciprocation of the piston.

14 Claims, 6 Drawing Figures

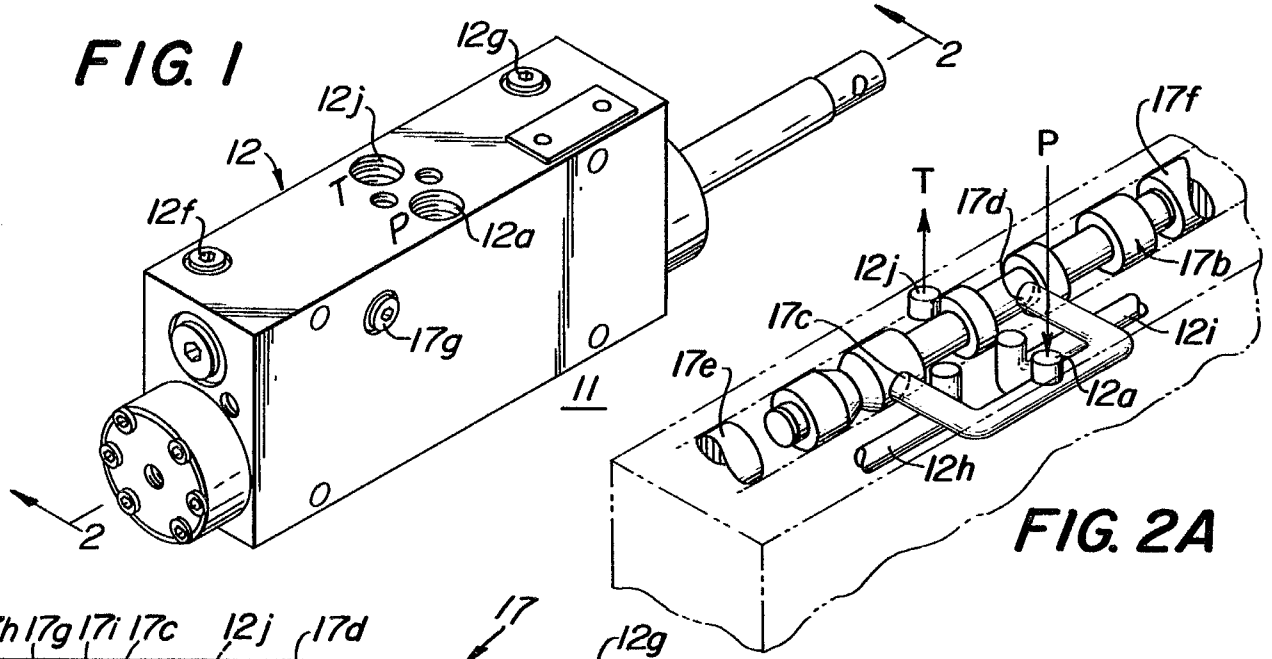
FIG. 1
FIG. 2A
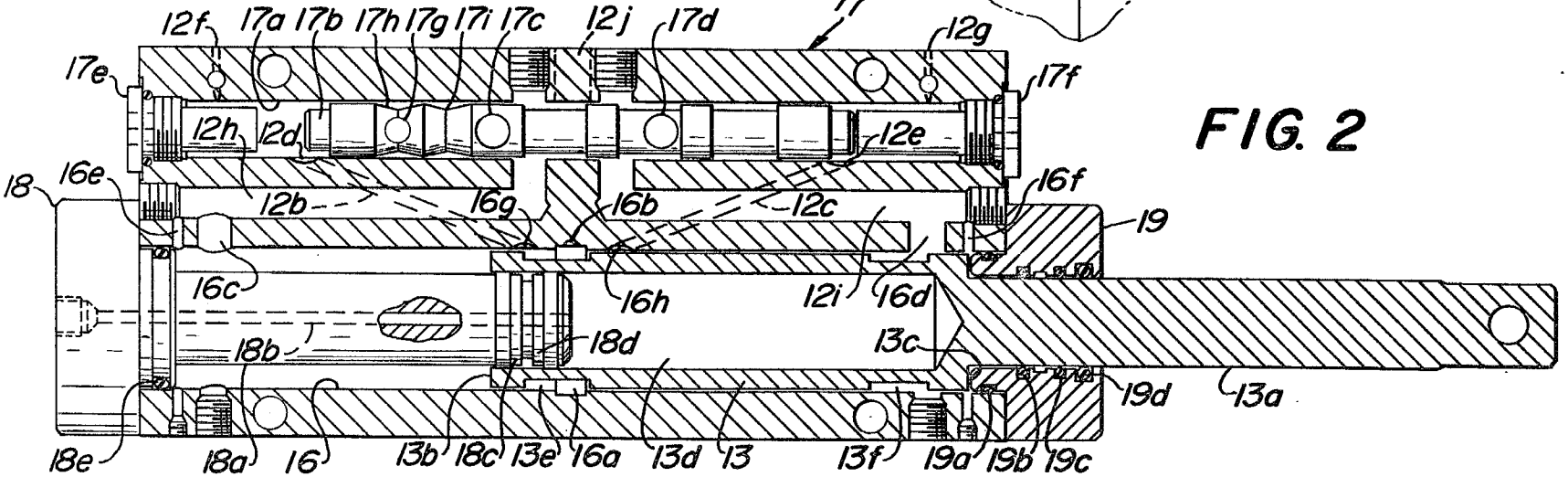
FIG. 2

EXTEND (PILOT TRIPPED TO RETRACT)

INTERMEDIATE (RETRACTING)

RETRACT (PILOT) TRIPPED TO EXTEND)

HYDRAULIC OSCILLATOR

BACKGROUND OF THE INVENTION

A. Field of the Invention

This invention relates to the field of art of hydraulic oscillators.

B. Prior Art

Hydraulic oscillators are known in the art and comprise a reciprocating piston within a cylinder controlled by a reversing valve such as a spool valve. For example, reciprocating piston oscillators are disclosed in the following U.S. Pat. Nos.:

3,450,349
3,643,548
3,780,622
3,786,723
3,896,889

However, the prior art hydraulic oscillators left much to be desired in applications which require continuous reciprocating motion at high volumetric efficiency as for example in supplying motive force to a cutter bar for a harvester. In such applications, it has been found herein that very fast tripping of a reversing valve is required to achieve rapid reversal of the pressurized main fluid flow to the cylinder housing the reciprocating piston. In this way, a hydraulic cushion must be provided in order to stop the piston short of its extreme travel position at either end of the cylinder or the piston would otherwise unacceptably strike the cylinder end. Another requirement is that the switching be accomplished without loss of pressure and with even pressure around the piston. Prior hydraulic oscillators have had many drawbacks and limitations in attempting to meet or even recognizing these stringent requirements.

SUMMARY OF THE INVENTION

A hydraulic oscillator in which a piston reciprocates between a first and a second position in a cylinder having first and second opposing ends. Reversing pilot valve means is operable in response to the application of pilot fluid flow for controlling the main fluid flow to the first and second cylinder ends. First and second pilot passages control the reversing operation of the pilot valve means and the cylinder has pilot channel means for flow of the pilot fluid. The piston has first coupling means for fluidly coupling the pilot channel means and the first pilot passage as the piston approaches the second position. The piston further has second coupling means for fluidly coupling the pilot channel means and the second pilot passage as the piston approaches the first position. In this manner, the pilot valve means is alternately reversed thereby to reverse the fluid flow to the cylinder ends to provide for the reciprocation of the piston.

BRIEF DESCRIPTION OF THE DRAWINGS

FIG. 1 is a perspective view of a hydraulic oscillator having a piston reciprocating within a cylinder according to the present invention;

FIG. 2 is an elevational sectional view of the hydraulic oscillator of FIG. 1 taken along lines 2—2;

FIG. 2A is a diagrammatic iosmetric view of an upper section of FIG. 2; and

DETAILED DESCRIPTION

Figure 3:
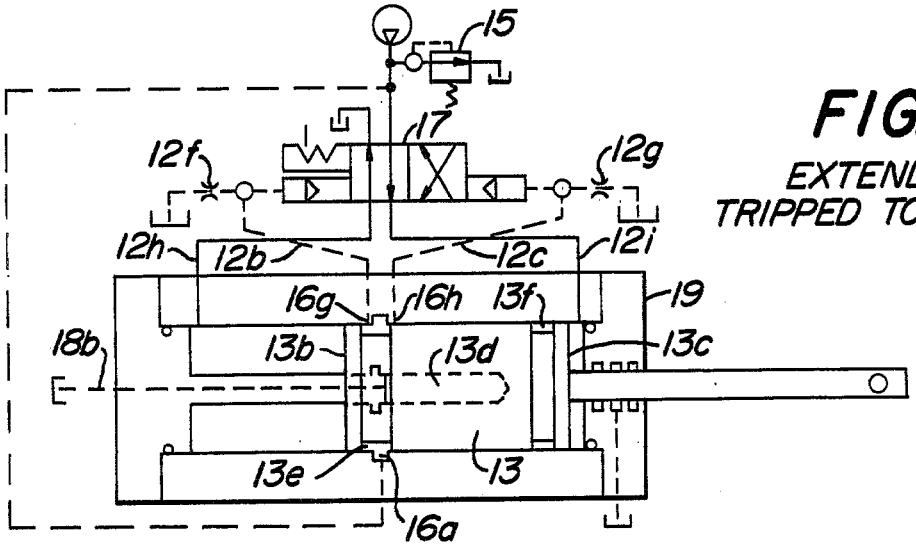
FIGS. 3–5 are partially schematic and partially simplified drawings of the piston and cylinder showing three discrete positions of the piston of FIG. 1 for purposes of explanation.

Referring to the drawings, oscillator 11 is a hydraulic device designed to provide continuous reciprocating motion, at high volumetric efficiency, when supplied with pressurized fluid from a separate hydraulic power source. A typical application may comprise supplying the motive force to a cutter bar for a grain crop harvester. Oscillator 11 in general comprises a rectangular body 12 housing a slidable piston 13 integral with a shaft **13*a* which transmits reciprocating motion to the equipment to be driven. A slidable-spool pilot valve 17, also housed within main body 12, directs pressurized fluid from the external power source alternately to the left- and right-hand faces 13*b* and 13*c* of piston 13. A relief valve 15, FIG. 3**, located in the line from the pressure source, external to the oscillator, functions to limit pressure peaks that can occur at time of piston reversal. If it should prove necessary, a backpressure valve will be provided to ensure availability of sufficient pressure to trip the pilot valve when the oscillator is operating in an unloaded or lightly loaded condition.

The detailed construction of oscillator 11 is shown in FIGS. 1 and 2. Oscillator body 12 is a rectangular housing with parallel longitudinal bores, the larger forming the operating cylinder 16, and the smaller defining the pilot-valve bore **17*a*. At the midpoint of the operating cylinder 16 a circumferential groove 16*a* is cut. This groove is supplied with pressurized fluid at all times by way of a port 16*b* communicating directly with pressure inlet port 12*a* on top of body 12. Two other oil ports 16*g* and 16*h* located in cylinder 16 immediately to the left and right of the circumferential groove 16*a* communicate by way of very short tangential passages 12*b* and 12*c* with the left- and right-hand ends, respectively, of pilot-valve spool 17*b*. Main pressure ports 16*c* and 16*d* located near each end of the operating cylinder 16 and auxiliary ports 16*e* and 16*f* located at the extreme ends of the cylinder connect by way of pressure ports 17*c* and 17*d* in pilot-valve bore 17*a* and passages 12*h* and 12*i* to pressure inlet port 12*a***.

The ends of the operating cylinder 16 are closed by end caps 18 and 19. Integral with the left-hand end cap 18 is an axially drilled rod **18*a* over which the hollow piston 13 slides. The external diameter of this rod is the same as that of piston shaft 13*a*, and its function is to provide the same effective working area of each of the faces 13*b* and 13*c* of the piston, thereby ensuring equal force and velocity for either direction of piston travel. The axial drilling 18*b* allows the space 13*d* inside the piston to communicate directly with tank to ensure neutral pressure conditions within the piston at all times. Seals 18*c* and 18*d* on the rod 18*a* are designed to prevent leakage from the left-hand side of the cylinder into the space 13*d* within the piston. Another seal 18*e* prevents leakage between the cylinder and the end cap. The right-hand end cap 19 is equipped with an identical seal 19*a* and, in addition, with two seals 19*b* and 19*c* and a wiper 19*d* to prevent leakage between the end cap 19 and the piston shaft 13*a***.

Piston 13 has grooves **13*e* and 13*f*, defined as logic grooves, formed near each end. Referring to FIGS. 2 and 3, as piston 13 nears the end of its stroke in the extended direction, logic groove 13*e* in the left-hand end of the piston overlaps, first the left-hand pilot outlet port 16*g* and then also the circumferential groove 16*a* of the cylinder 16. By this means pressurized fluid is directed very rapidly to the left-hand end of the pilot valve spool 17***b*, causing the spool to shift instantly and direct fluid from pressure inlet port 12*a* to the right-hand face 13*c* of the piston 13, in time to prevent the piston from striking end cap 19 before initiating piston stroke reversal. As the piston nears the end of its retracting stroke, logic groove 13*f* in the right-hand end of the piston functions in the manner just described for groove 13*e* to again stop and then reverse piston direction.

Pilot valve 17 is defined by a spool 17*b* slidably located in the pilot valve bore 17*a*. With the spool positioned at the right-hand end of the bore 17*a* as shown in FIGS. 2, 2A and 3 fluid flows from pressure inlet port 12*a*, through uncovered port 17*d*, bore 17*a*, line 12*i* and then to the right-hand end of the operating cylinder 16 through main and auxiliary ports 16*d* and 16*f*. In this spool position, fluid flows from the left-hand end of cylinder 16, through ports 16*c,e* and line 12*h* and bore 17*a* which communicates with outlet port 12*j*. When the spool 17*b* is shifted to the left-hand end of the valve bore 17*a*, which is the position shown in FIG. 5, fluid flows from inlet port 12*a*, through port 17*c* then uncovered and bore 17*a*, line 12*h* to the left-hand end of the cylinder 16. In this spool position fluid flows from the right-hand end of cylinder 16, line 12*i* and bore 17*a* which then communicates with outlet port 12*j*. Valve end caps 17*e* and 17*f*, in addition to sealing the ends of the valve bore 17*a*, also limit the travel of the spool 17*b*. Pilot inlet ports 12*d* and 12*e* near each end of the pilot valve bore 17*a* communicate with pilot outlet ports 16*g* and 16*h* on each side of the circumferential groove 16*a* of the operating cylinder 16 as previously described.

Orifices 12*f* and 12*g* at either end of the valve bore 17*a* allow fluid to bleed back to tank when the spool moves. For example, pilot pressure applied to the left-hand end of spool 17*b* through port 12*d* first swamps the orifice 12*f* at that end and then, when pressure has built up sufficiently, moves the spool 17*b* fully to the right-hand end of the bore 17*a*. This movement causes fluid in the right-hand end of the spool to be forced back to tank through orifice 12*g*. Using this method to shift the spool greatly simplifies pilot-valve logic, because fluid has to be directed to one side of the valve only; it is not necessary to switch the depressurized side to tank, since both orifices 12*f* and 12*g* are always connected to tank. Orifices 12*f* and 12*g* also serve to maintain tank pressure on each end of the valve spool 17*b* when the piston 20 is near mid-stroke, to ensure that minor pressure variations will not cause the pilot valve to trip. In addition, a spring-loaded detent ball 17*g* engages groove 17*h* and 17*i* in the spool 17*b* to keep the spool latched fully home at one end of the valve bore 17*a* until positive pressure is applied to that end of the spool.

Referring to FIGS. 2–5, the operating sequence of the oscillator is described as follows. FIG. 3 shows the piston 13 in the almost (or approaching) fully extended position, but with the pilot valve 17 tripped to retract. In arriving at this position, the piston left-hand logic groove 13*e* overlaps first the left-hand pilot outlet port or channel 16*g* and then also the pilot inlet port 16*b* (located on the periphery of the cylinder circumferential groove or channel 16*a*). With these two ports in communication, pressurized fluid is directed through left-hand pilot passage 12*b* to the left-hand end of pilot valve bore 17*a*. This flow first swamps the left-hand orifice 12*f* and then, when pressure has built up, shifts the spool 17*b* to the extreme right-hand position (valve tripped to retract as shown in FIG. 3). This movement of the spool forces fluid from the right-hand end of reversing spool valve 17 back to tank through right-hand orifice 12*g*. Pressure inlet port 12*a* is thus connected via right-hand main oil passage 12*i* to right-hand main and auxiliary ports 16*d* and 16*f*, applying pressure to the piston right-hand face 13*c*. This pressure is effective to prevent the piston from striking end cap 19 and then, as flow increases, to initiate the retraction phase. At this time, left-hand main and auxiliary ports 16*c* and 16*e* are connected to tank via left-hand main oil passage 12*h* and return port 12*j*.

Figure 4:
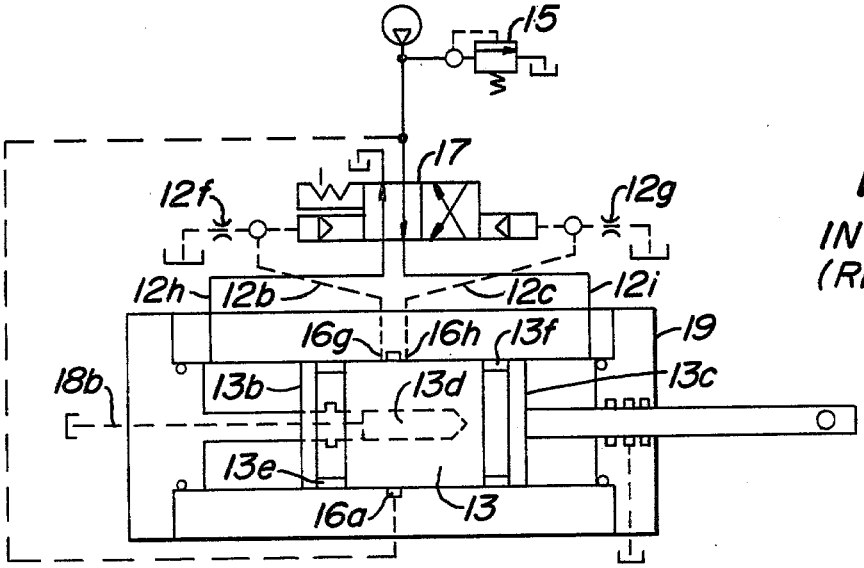

FIG. 4 shows the piston 13 in an intermediate retracting position. Pressure is still applied to the right-hand piston face 13*c*, and left-hand main and auxiliary ports 16*c* and 16*e* are still connected to tank. Since circumferential groove 16*a* is covered by the full-diameter skirt of piston 13, there is no fluid flow between pilot inlet port 16*b* and pilot outlet 16*g*. However, pilot valve 17 is held tripped to retract position by detent ball 17*g* engaging detent groove 17*h*. In addition, since orifices 12*f* and 12*g* are open to tank at all times, they ensure that any slight pressure transient that might occur as the pilot valve nears midtravel will have no effect on the pilot valve spool 17*b* (that is, they will not cause the spool to trip permaturely). During the retract phase fluid in the piston internal cavity 13*d* is relieved to tank through axial drilling 18*b*.

Figure 5:
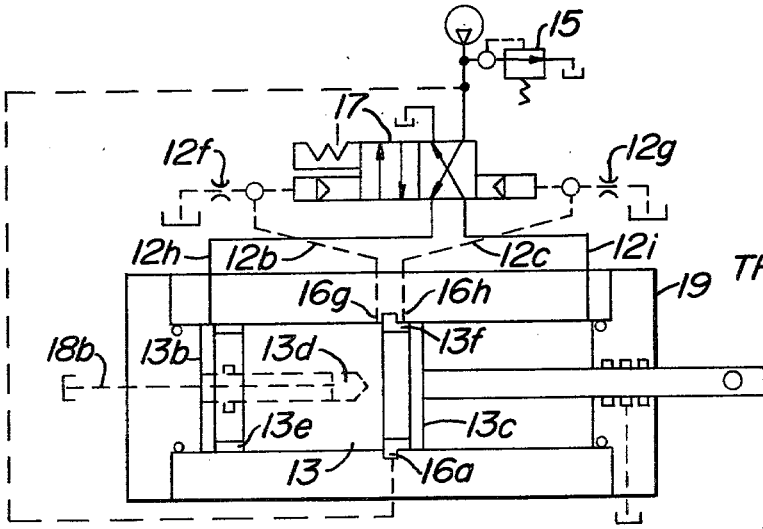

In FIG. 5, the piston 13 is almost fully retracted, with the pilot valve 17 already tripped to extend. The piston right-hand logic groove 13*f* is overlapping both the right-hand pilot outlet port 16*h* and the pilot inlet port 16*b*. Similarly to the fully extended situation already described, these two ports are now in communication, causing pressurized fluid to be directed through right-hand pilot passage 12*c* to the right-hand end of pilot valve bore 17*a*. Again the flow of fluid first swamps right-hand orifice 12*g* before shifting spool 17*b* fully left (valve tripped to extend as shown in FIG. 5) while fluid is forced from left-hand orifice 12*f* back to tank. With the pilot valve thus tripped to extend, pressure inlet port 12*a* is connected via left-hand main oil passage 12*h* to left-hand main and auxiliary ports 16*c* and 16*e*. By this means, pressure is applied to the left-hand piston face 13*b* to first prevent the piston from striking left-hand end cap 18, and then, as flow increases to move the piston in the extend direction. During this time, right-hand main and auxiliary ports 16*d* and 16*f* are connected to tank through right-hand main oil passage 12*i* and return 12*j*.

One of the important features herein is the circumferential groove 16*a*, located at the midpoint of the operating cylinder 16 and operating in conjunction with logic grooves 13*e* and 13*f* located near each end of the piston 13. Since pilot pressure is applied to the circumferential groove at all times, via pilot inlet port 16*b* located on the periphery of the groove, very fast tripping of the pilot valve results when one of the logic grooves 13*e* or 13*f* of the piston overlaps the circumferential groove and one of the pilot outlets 16*g* or 16*h*. This means that a rapid reversal of main pressurized fluid flow is achieved to provide a hydraulic cushion to stop the piston short of its extreme travel position at either end of the cylinder.

Also, since this very rapid switching of pressurized flow from one side of the piston to the other is normally accomplished without loss of pressure (that is to say, the pressure is bounced back towards the pump and the relief valve normally does not open), it means that the momentary increase in pressure experienced is available to augment the pressure applied in the new direction of travel. This, taken together with another design feature—the very short tangential pilot passages 12*b* and 12*c* to which the circumferential groove 16*a* connects when exposed by one of the piston logic grooves 13*e* or 13*f*—ensures high volumetric efficiency of the device, i.e., there are no travel losses or pumping losses associated with movement of the fluid.

Finally, with the circumferential groove, pressure is distributed evenly around the piston 13. This ensures that when the piston is in any intermediate position, it is not subjected to side-loading such as would occur if the pilot pressure was delivered to a port sealed directly by the major diameter of the piston.

Another significant feature is the use of orifices 12*f* and 12*g* to vent each end of the pilot valve bore 17*a* to tank at all times. By this means, pilot valve actuating logic is greatly simplified. That is to say, when pilot pressure is applied to one end of the valve spool 17*b*, the flow first swamps the orifice at that end (since pilot outlet port 12*d* or 12*e* is much larger than the related orifice 12*f* or 12*g*) and then, when pressure has built up at that end, moves the spool, causing fluid at the other end of the valve. In other words, separate logic for switching the return flow from the pilot valve to tank is not required. A secondary function of the pilot valve orifices is to regulate pressure applied to the spool so that any slight pilot pressure transients that might be experienced as the piston travels through intermediate positions, will not be effective to shift the spool prematurely.

It will be understood that circumferential groove 16*a* is effectively positioned so that it operates to produce the switching action of reversing pilot valve 17 in the manner described above. Thus, groove or channel 16*a* is positioned so that as shown in FIG. 3, channel 13*e* only overlaps groove 16*a* and port 16*g*. In the position shown in FIG. 5, groove 13*f* only overlaps groove 16*a* and port 16*h*.

What is claimed is:

1. A hydraulic oscillator comprising a piston reciprocating between first and second positions in a cylinder having first and second opposed ends, reversing pilot valve means operable in response to the application of pilot fluid flow for controlling flow of fluid to said first and second cylinder ends, first and second pilot passages for controlling the reversing operation of said pilot valve means, said cylinder having pilot channel means including a single circumferential pilot pressure groove formed on a cylinder wall for flow of said pilot fluid, and said piston having (1) first coupling means for fluidly coupling said single pilot groove and said first pilot passage as said piston approaches said second position and (2) second coupling means free of fluid communication with said first coupling means for fluidly coupling said single pilot groove and second pilot passage as said piston approaches said first position thereby to alternately reverse said pilot valve means to reverse the fluid flow to said first and second cylinder ends for producing the reciprocation of said piston.

2. The hydraulic oscillator of claim 1 in which said pilot channel means is disposed intermediate the first and second opposed ends of the cylinder at a position to provide for said fluid couplings at said approaches of said piston to said first and second positions.

3. The hydraulic oscillator of claim 2 in which said first and second pilot passages are positioned on the wall of said cylinder adjacent said pilot groove.

4. The hydraulic oscillator of claim 3 in which said first coupling means includes a first overlapping logic groove formed on said piston for overlapping said pilot groove and said first pilot passage as said piston approaches said second position.

5. The hydraulic oscillator of claim 4 in which said second coupling means includes a second overlapping logic groove formed on said piston for overlapping said pilot groove and said second pilot passage as said piston approaches said first position.

6. The hydraulic oscillator of claim 5 in which said pilot groove and said first groove are positioned so that when overlapped by said first logic groove said pilot valve means is reversed in time to apply fluid within said second cylinder end to prevent said piston from striking said second cylinder end.

7. The hydraulic oscillator of claim 6 in which said pilot groove and said second groove are positioned so that when overlapped by said second logic groove said pilot valve means is reversed in time to apply fluid within said first cylinder end to prevent said piston from striking said first cylinder end.

8. A hydraulic oscillator for producing continuous reciprocating motion comprising a reciprocating piston in a cylinder, said piston having first and second opposed faces which respectively communicate with first and second opposed ends of the cylinder.

reversing pilot valve means operable for controlling pressurized fluid flow to said first and second cylinder ends, first and second pilot passages coupled to said pilot valve means for flow of pilot fluid for controlling the reversing operation of said pilot valve means, said cylinder having a pilot channel formed intermediate the first and second cylinder ends and comprises a single circumferential pilot pressure groove formed on a cylinder wall for flow of said pilot fluid, said first and second pilot passages being formed in said cylinder adjacent said pilot channel, and said piston having (1) a first logic channel positioned for overlapping and fluidly coupling said single pilot groove and said first pilot passage only when said piston reaches a second predetermined position approaching said second cylinder end and (2) a second logic channel, free of fluid communication with said first logic channel positioned for overlapping and fluidly coupling said single pilot groove and said second pilot passage only when said piston reaches a first predetermined position approaching said first cylinder end whereby said reversing pilot valve means alternately operates to rapidly reverse pressurized fluid flow to said first and second cylinder ends.

9. The hydraulic oscillator of claim 8 in which said first and second pilot passages are positioned on the wall of said cylinder adjacent said pilot groove.

10. The hydraulic oscillator of claim 9 in which said first and second logic channels define first and second logic grooves.

11. The hydraulic oscillator of claim 10 in which said pilot groove and said first groove are positioned so that when overlapped by said first logic groove said pilot valve means is reversed in sufficient time to apply fluid within said second cylinder end to prevent said piston from striking said second cylinder.

12. The hydraulic oscillator of claim 11 in which said pilot groove and said second groove are positioned so that when overlapped by said second logic groove said pilot valve means is reversed in sufficient time to apply fluid within said first cylinder end to prevent said piston from striking said first cylinder end.

13. The hydraulic oscillator of claim 8, 9 or 12 in which there is provided a rod secured to said first cylinder end adapted to be received within said first face of said piston, a piston shaft secured to said second face having an external diameter the same as that of said rod to provide similar effective working areas of said first and second piston faces.

14. The hydraulic oscillator of claims 8, 9 or 12 in which said reversing pilot valve means is a spool valve.

* * * * *